US007510348B2

(12) United States Patent
James

(10) Patent No.: US 7,510,348 B2
(45) Date of Patent: Mar. 31, 2009

(54) ROAD SHOULDER WORKING APPARATUS

(76) Inventor: Edwin Harry James, 7050 Somenos Road, Duncan, British Columbia (CA) V9L 5Z5

( * ) Notice: Subject to any disclaimer, the term of this patent is extended or adjusted under 35 U.S.C. 154(b) by 529 days.

(21) Appl. No.: 11/261,465

(22) Filed: Oct. 31, 2005

(65) Prior Publication Data

US 2007/0098497 A1 May 3, 2007

(51) Int. Cl.
*E01C 19/12* (2006.01)

(52) U.S. Cl. ..... 404/96; 404/104; 172/172; 172/782; 172/787

(58) Field of Classification Search ..... 172/175, 172/195, 782, 785, 787, 791, 795; 404/101–104, 404/96, 113, 118
See application file for complete search history.

(56) References Cited

U.S. PATENT DOCUMENTS

| | | | | |
|---|---|---|---|---|
| 222,362 | A * | 12/1879 | Mooers | 172/785 |
| 367,736 | A * | 8/1887 | Wise et al. | 172/170 |
| 4,156,466 | A | 5/1979 | Caldwell | 172/4.5 |
| 4,643,261 | A | 2/1987 | Long | 172/2 |
| 4,702,644 | A | 10/1987 | Cioffi | 404/128 |
| 5,108,221 | A | 4/1992 | Skibsted | 404/128 |
| 5,304,013 | A | 4/1994 | Parsons | 404/127 |
| 5,332,331 | A | 7/1994 | Critz et al. | 404/96 |
| 5,810,097 | A | 9/1998 | McMillan | 172/782 |
| 5,864,970 | A * | 2/1999 | Maddock et al. | 37/94 |
| 6,164,866 | A | 12/2000 | Wulff | 404/108 |
| 6,293,345 | B1 | 9/2001 | Watkins | 166/368 |
| 6,293,354 | B1 * | 9/2001 | Garratt et al. | 172/784 |
| 6,612,774 | B1 | 9/2003 | Dulin | 404/104 |
| 6,793,437 | B2 | 9/2004 | Kitko et al. | 404/126 |

* cited by examiner

*Primary Examiner*—Gary S Hartmann
(74) *Attorney, Agent, or Firm*—Fasken Martineau DuMoulin LLP

(57) ABSTRACT

A road shoulder working, grooming and compacting apparatus is configured to demountably cooperate with self-propelled operator-controlled machines. The apparatus comprises a first component for controllably working an outer portion of a road shoulder region to urge granular aggregate materials therefrom toward and onto a road surface, a second component positioned posterior to the first component and vertically movable between disengaged and engaged positions for controllably transferring granular aggregate material from a road surface to a road shoulder region, and a third component positioned posterior the second component for controllably distributing, grooming and compacting granular aggregate materials contained within the road shoulder region. The first and third components are movable between raised retracted positions and laterally-deployed lowered positions for engaging and working road shoulder regions while the self-propelled operator-controllable machine travels along a road surface. A fourth component is optionally provided interposed the second and third components for brushing road surfaces.

36 Claims, 9 Drawing Sheets

ROAD SHOULDER WORKING APPARATUS

FIELD OF THE INVENTION

This invention relates to an apparatus for working road shoulders. More particularly, this invention relates to an apparatus for working road shoulders comprising granular aggregate materials.

BACKGROUND OF THE INVENTION

Paved and concrete roadways are typically provided with shoulder regions which provide sufficient space to enable vehicles to safely pull off from the roadways for various reasons such as emergency repairs, driver and passenger rest, and parking. Road shoulders are typically supplied in the form of granular aggregate substrates such as gravel, crushed rock, sand, pebbles, crushed shells, crumbed waste rubber and other such materials and mixtures of such materials. Road shoulders comprising such granular aggregate materials must be significantly compacted in order to provide suitably dense matrices to support the weights of vehicles as they transition under some speed from the hard road surfaces to the road shoulders, During construction of new roads or re-surfacing of existing roads, the shoulder regions are prepared and worked by dispensing fresh aggregate materials adjacent the road surfaces after which, the road shoulders are worked to draw the aggregate materials against the road surfaces, then smoothed or groomed, and finally compacted by specialized equipment such as motor graders and self-propelled vibratory compacting rollers. Freshly worked and distributed road shoulders are typically very soft and susceptible to forming deep ruts caused by the wheels of equipment used for the initial grooming steps thereby resulting in uneven compacting and poor shoulder stability after compacting has been completed. Furthermore, the grooming steps often require the mouldboards of motor graders to move spilled or excess granular substrates from the surfaces of newly paved or poured road surfaces to the shoulders thereby often causing gouging, tearing or ripping of the newly paved or poured road surfaces which significantly reduces their durability and longevity. Attempts to solve these problems include the development of devices mountable onto dump trucks or specialized self-propelled equipment as exemplified in U.S. Pat. Nos. 5,304,013, 6,164,866, and 6,612,774, for creating and working road shoulders without requiring the trucks or equipment to leave the road surfaces.

Road shoulders are typically positioned adjacent to man-made ditches or gullies to facilitate water egress from the road surfaces. However, excessive rainfalls often result in the formation of rapidly flowing water channels that cut crevices and fissures into road shoulders thereby causing losses of the granular aggregate substrates into the ditches and gullies resulting in destabilization and deterioration of the road shoulders, thus creating hazardous conditions for vehicles transitioning from the road surfaces to the shoulders. Consequently, such road shoulders require regular periodic maintenance with specialized equipment to reclaim road shoulder substrates washed away into adjacent ditches and gullies, followed by their recycling back onto the road shoulder portions which are then reformed and compacted. For example, road shoulder substrates which have washed away into adjacent ditches and gullies may be recovered and transferred onto the road surface by a motor grader equipped with a gang of disc harrows as exemplified in U.S. Pat. No. 5,810,097, and then transferred back to the road shoulder portion by the grader mouldboard. The reclaimed road shoulders may then be worked and groomed by various types of devices as taught by U.S. Pat. Nos. 4,156,466 and 5,332,331, after which the groomed road shoulders may be compacted. However, such road shoulder reclaiming and reforming operations require at least two or more specialized self-propelled equipment such as motor graders that are provided with selected demountable devices adapted for working road shoulders wherein each operation is performed in a separate pass. Consequently, road shoulder forming and reclaiming operations are costly and time-consuming.

Another problem often encountered during road shoulder reclaiming operations is caused by the presence of debris or alternatively, vegetation that commonly establishes and proliferates at the outer margins of road shoulder surfaces and along their side edges sloping into the adjacent ditches and gullies. Such debris and vegetation are typically pulled in clumps onto road surfaces during the shoulder recovery operation, then redistributed across the new shoulder surfaces formed as the granular aggregate materials are transferred back to the road shoulder regions, and then compacted into the newly formed road shoulders. The presence of debris and/or clumps of vegetation on and in newly worked road shoulders results in uneven compaction thereby resulting in unstable road shoulders that quickly deteriorate and subsequently, more frequently require costly and time-consuming road shoulder reclaiming and grooming operations.

SUMMARY OF THE INVENTION

The exemplary embodiments of the present invention, at least in some forms are directed to the working, grooming and compaction of road shoulders.

According to an exemplary embodiment of the invention, there is provided a deployable retractable apparatus configured for demountably cooperating with a self-propelled operator-controlled machine, for engaging, disrupting and urging granular aggregate materials from an outer portion of a road shoulder region toward and partially onto a road surface, then transferring the granular aggregate materials from the road surface back onto the road shoulder region after which, the granular materials are distributed across the road shoulder region, groomed and compacted to form a densified substrate suitable to bear the weight of a vehicle transitioning from the road surface to the road shoulder region. The self-propelled operator-controlled machine is configured to travel along the road surface wherefrom the apparatus is laterally deployed to engage and work the road shoulder region.

According to one aspect of the invention, the apparatus is provided with a first component configured for engaging, disrupting and urging granular aggregate materials from an outer portion of a road shoulder region toward and partially onto a road surface. The first component comprises a frame mounting thereon a plurality of cooperating devices for engaging, disrupting and urging granular aggregate materials. The frame is movable between a retracted upward and inward raised position and a laterally-deployed and lowered position whereby the cooperating devices are arranged to controllably engage the outer portion of the road shoulder region.

In a preferred form, the plurality of cooperating devices mounted on the frame of the first component comprises a plurality of substantially parallel spaced apart discs. Each disc is provided with a cutting edge about its periphery arranged to engage a road shoulder for digging up and urging granular aggregate material towards a road surface when the first component is engaged with a road shoulder region.

In another preferred form, the plurality of cooperating devices mounted on the frame of the first component comprises a plurality of substantially parallel spaced apart ploughshares. Each ploughshare is configured with a leading cutting edge and a generally inward inclined concave following surface arranged to engage a road shoulder for digging up and urging granular aggregate material towards a road surface when the first component is engaged with a road shoulder region.

In a further preferred form, the plurality of cooperating devices mounted on the frame of the first component comprises a plurality of substantially parallel spaced apart elongate plates. Each plate is configured with a leading plate portion for cutting into a road shoulder and a generally inward inclined following plate portion arranged for digging, turning and urging granular aggregate material from the road should towards a road surface when said first component is engaged with a road shoulder region.

According to a second aspect of the invention, the apparatus is provided with a second component configured for transferring granular aggregate materials from the road surface onto the road shoulder region. The second component is positioned posterior to the first component, In a preferred form, the second component is provided with a structural support communicating and cooperating with a mouldboard which extends below the structural support. The structural support is movable in a vertical axis between a raised retracted position and a lowered engaged position whereby the bottom edge of the mouldboard slidingly communicates with the road surface.

In another preferred form, the mouldboard is provided with a bottom edge having an upward inclined distal end portion.

In a further preferred form, the mouldboard is adjustable along the vertical axis by a cable communicating with the structural support.

According to a third aspect of the invention, the apparatus is provided with a third component provided for evenly distributing and grooming said granular aggregate materials across the road shoulder region and then compacting the groomed road shoulder region to form a densified substrate suitable for bearing the weight of a vehicle transitioning from the road surface to the road shoulder region The third component is positioned posterior to the second component.

In a preferred form, the third component is provided with a framework mounting therein a plurality of rotatable cooperating devices extending therefrom for evenly distributing and grooming said granular aggregate materials across the road shoulder region and for compacting the groomed road shoulder region. The framework is movable between a retracted upward and inward raised position and a lowered, laterally-deployed engaged position wherein the rotatable cooperating devices are arranged to controllably engage and work the road shoulder region.

In another preferred form, the third component is provided with a framework having mounted therein a leading elongate augering roller for movably engaging a worked road shoulder region for distributing and grooming granular aggregate materials across the road shoulder region from a road surface edge to the outer portion of the road shoulder region when the third component is laterally deployed in an engaged position from a self-propelled operator-controlled machine travelling along a road surface adjacent said road shoulder region. A drive means is provided to one end of the augering roller for rotating the augering roller in a direction opposite to the direction of travel of the self-propelled operator-controlled machine. The augering roller is additionally useful for removing and discharging from the road shoulder region clumps of vegetation, rocks, debris and litter.

In a further preferred form, the third component is provided with a framework having mounted therein a following roller for compacting granular aggregate materials into the road shoulder region. If so desired, the compacting roller may be a vibratory roller. The compacting roller may be optionally provided with a longitudinally extending scraper blade for removing material from an outer surface of the roller. It is preferable the scraper blade is adjustably interconnected with the framework and that the scraper blade slidingly communicates with the compacting roller.

According to a fourth aspect of the invention, the apparatus is provided with a fourth component interposed the second and third components for sweeping granular aggregate materials left on a road surface by the second component, onto a road shoulder region in front of the third component.

In a preferred form, the fourth component comprises a rotary broom device, said rotary broom device movable in a vertical axis between a raised retracted position and a lowered engaged position for sweepingly engaging a road surface.

According to another preferred embodiment of the invention, there is provided a deployable retractable apparatus configured for demountably cooperating with self-propelled operator-controlled machine, for engaging, disrupting and urging granular aggregate materials from an outer portion of a road shoulder region toward and partially onto a road surface with a first component, then transferring the granular aggregate materials from the road surface back onto the road shoulder region with a second component.

In a preferred form, the first component is provided with a frame that is pivotably engaged with a support structure of the second component wherefrom the first component is laterally extendable and pivotable for controllably engaging an outer portion of a road shoulder region and is retractable therefrom. The support structure of the second component is configured to demountably engage the undercarriage of a self-propelled operatorcontrolled machine.

According to another preferred embodiment of the invention, the apparatus of the present invention when demountably cooperating with self-propelled operator-controlled machine, is provided with a plurality of cooperating hydraulically controlled actuators for concurrently but independently: (a) laterally deploying the first and third components cooperating with self-propelled operator-controlled machine on a road surface therefrom to a road shoulder region, (b) vertically and pivotably controlling the engagement of said laterally deployed components with the road shoulder portion, (c) retraction of said first and third components therefrom, (d) controlling the communication of the second component with the road surface, and (e) retraction of the second component therefrom.

In a preferred form, the first and second components are configured to demountably engage the undercarriage of a self-propelled operator-controlled machine, and the third component is configured to cooperatingly demountably engage the undercarriage and drive train components of a self-propelled operator-controlled machine. The third component is optionally configured to emountably engage the undercarriage of a self-propelled operator-controlled machine.

According to yet another preferred embodiment of the invention, there is provided a self-propelled operated-controllable machine integrally provided with a deployable retractable apparatus configured for demountably cooperating with self-propelled operator-controlled machine, for engaging, disrupting and urging granular aggregate materials from an outer portion of a road shoulder region toward and partially onto a road surface, then transferring the granular aggregate materials from the road surface back onto the road shoulder region after which, the granular materials are distributed across the road shoulder region, groomed and compacted to form a densified substrate suitable to bear the weight of a vehicle transitioning from the road surface to the road shoulder region. The self-propelled operator-controlled machine is configured to travel along the road surface wherefrom the apparatus is laterally deployed to engage and work the road shoulder region.

BRIEF DESCRIPTION OF THE DRAWINGS

The present invention will be described in conjunction with reference to the following drawing, in which.

DETAILED DESCRIPTION OF THE INVENTION

Figure 1:
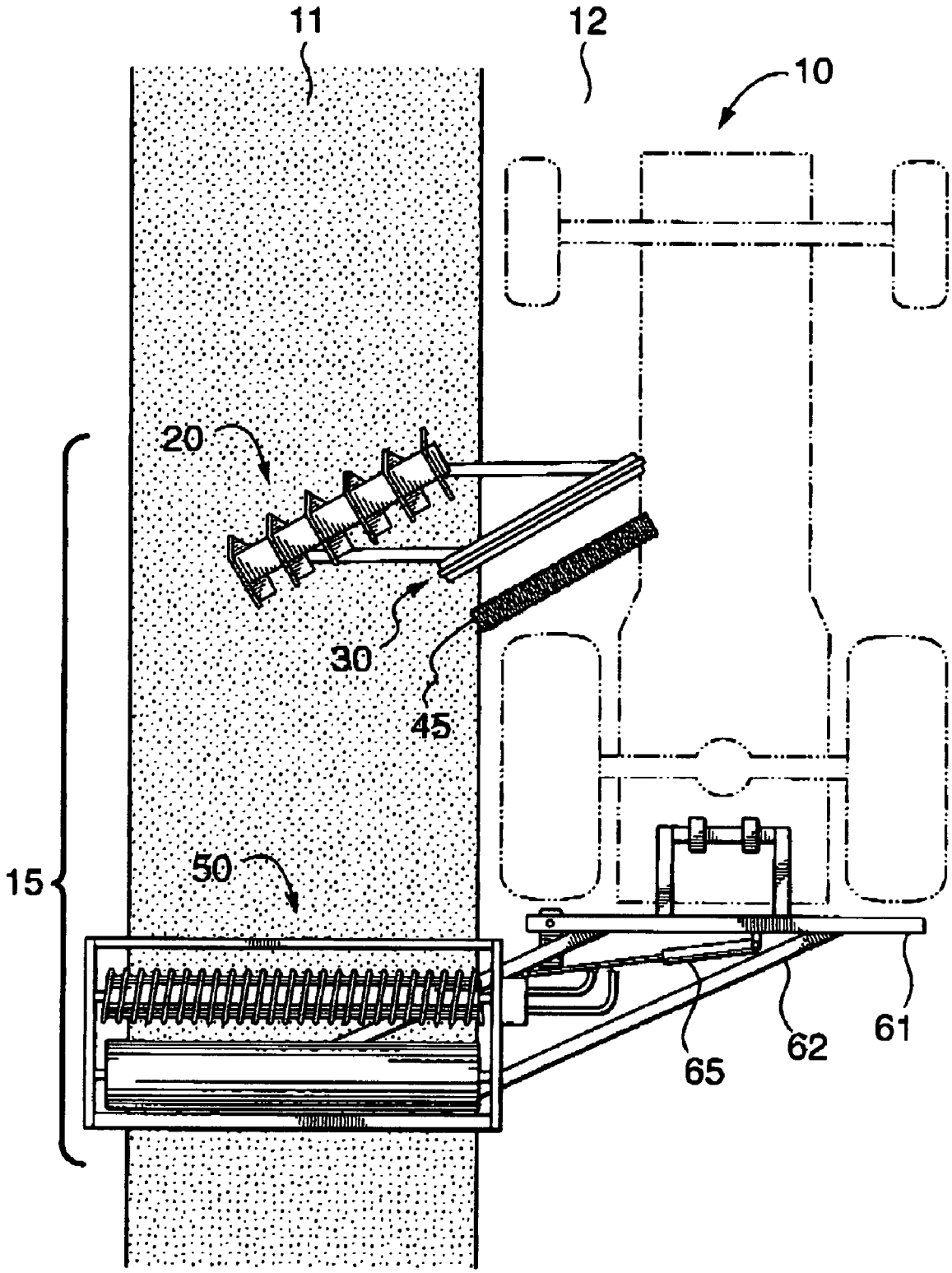
FIG. 1 is a bottom view of a preferred embodiment of the present invention shown mounted on a tractor in deployed positions for engaging and working road shoulders.

The accompanying drawings show an exemplary embodiment of the road shoulder working, grooming and compacting apparatus attached to a self-propelled operator-controllable machine, wherein the apparatus is generally referred to by the numeral 15 and the self-propelled operator-controllable machine is generally referred by the numeral 10. As can best be seen in FIGS. 1 and 2 which are bottom views looking up at the undercarriage of the machine 10, the apparatus 15 comprises a first component 20 for engaging an outer portion of a road shoulder region 11 for digging into, turning over and urging granular aggregate materials toward and onto a road surface 12, a second component 30 for transferring granular aggregate materials from the road surface 12 back onto the road shoulder region 11, a third component 50 for distributing and grooming granular aggregate materials across the surface of the road shoulder region 11. The apparatus 15 is optionally provided with a rotary broom device 45 positioned between the second and third components 30 and 50 for sweeping granular aggregate materials left behind on the road surface 12 by the second component, onto the road shoulder region 11. As shown in FIG. 1, the first and third components 20 and 50 are preferably laterally-deployable and extendable to the operator's right side (shown on the left side in the bottom-up views of FIGS. 1 and 2) beyond the outside wheel base of the self-propelled machine 10 so that machine 10 can travel along on the surface 12 of a paved asphalt or poured concrete roadway while the first and third components controllably engage and work granular aggregate materials situated in the road shoulder region 11 adjacent the roadway 12. The second component 30 and the fourth component 45 are movable in a vertical axis whereby, when in lowered positions, the second component 30 sliding engages the road surface 12 to transfer granular aggregate materials to the road shoulder region, while the fourth component 45 brushes the road surface 12 to sweep granular materials left behind by the second component onto the road shoulder region 11. The second and fourth components 30 and 45 are vertically retractable from the road surface 12 when desired.

Figure 2:
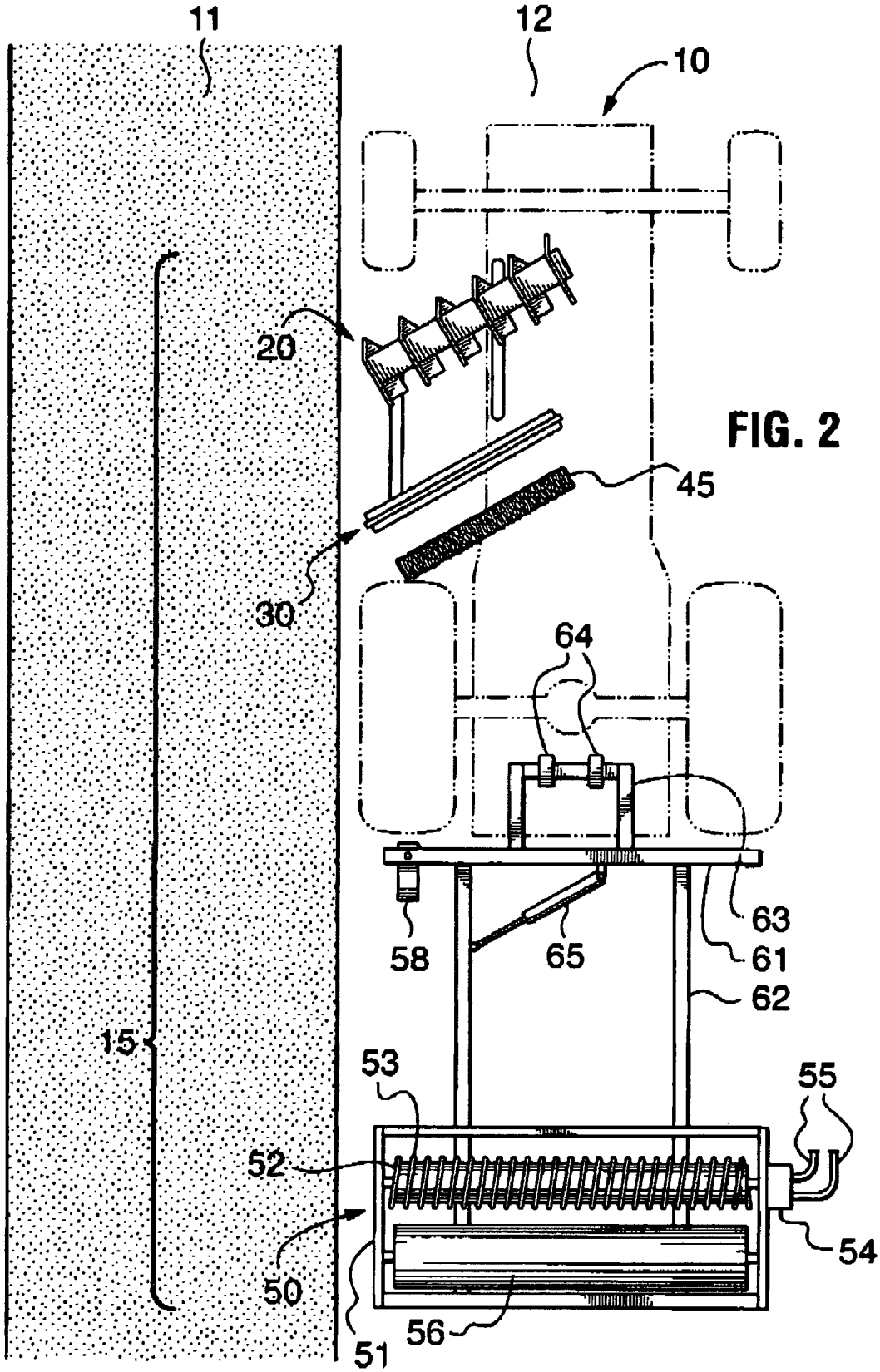
FIG. 2 is a bottom view of the embodiment from FIG. 1 shown in raised retracted positions.

As shown in FIG. 2, the first component 20 is laterally retractable to a position adjacent the machine 10 with only a small portion of component 20 extending beyond the wheelbase of machine 10, while component 50 is laterally retractable to a position directly behind machine 10. If so desired, the first, second, third and fourth components may comprise separate units which may be individually demountably coupled to a suitable self-propelled operator-controlled machine which, for example, may be a tractor, a motor grader, a dump truck or other such machine. Alternatively, it is possible within the scope of the present invention to combine two or more of components one, two, three and four into one or more multifunctional components as will be described in more detail below. When the first, second, third and fourth components are demountably coupled to suitable machine, they can be independently and concurrently deployed, operated and controlled by various types of actuators communicating with one or more hydraulic, pneumatic, electronic, electrical and mechanical control systems known to those skilled in this art. When first, second, third and fourth components 20, 30, 45 and 50 are retracted, the self-propelled machine 10 may be driven away from the job site by the operator or, alternatively, may be directed onto a flat-bed trailer for conveyance away from the job site.

Figure 3B:
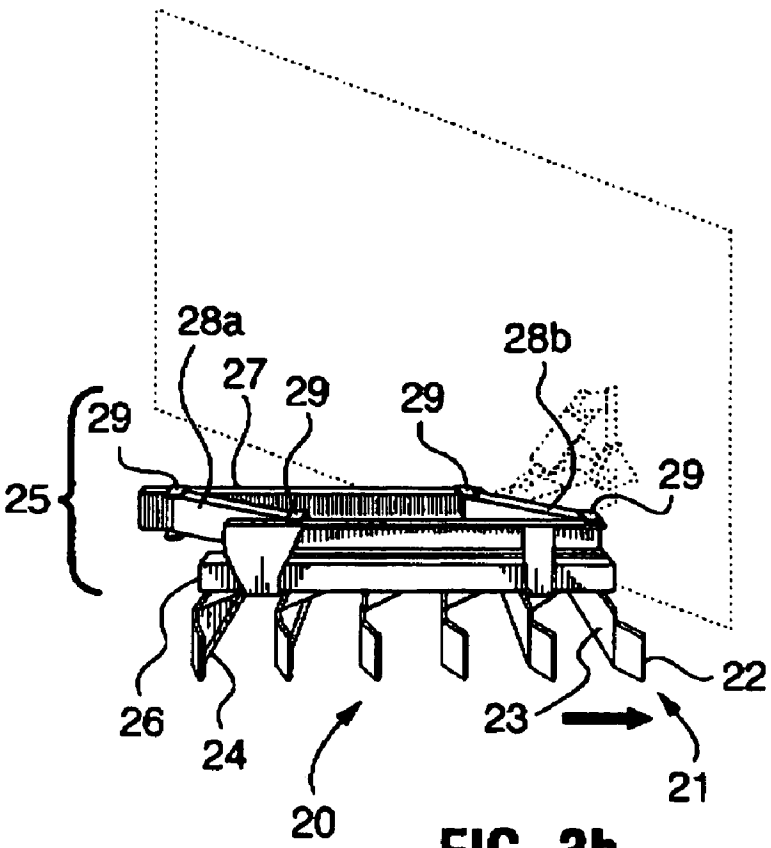
FIG. 3*b* is a perspective view from the front of the embodiment from FIG. 3*a*, shown in a retracted position.
Figure 3A:
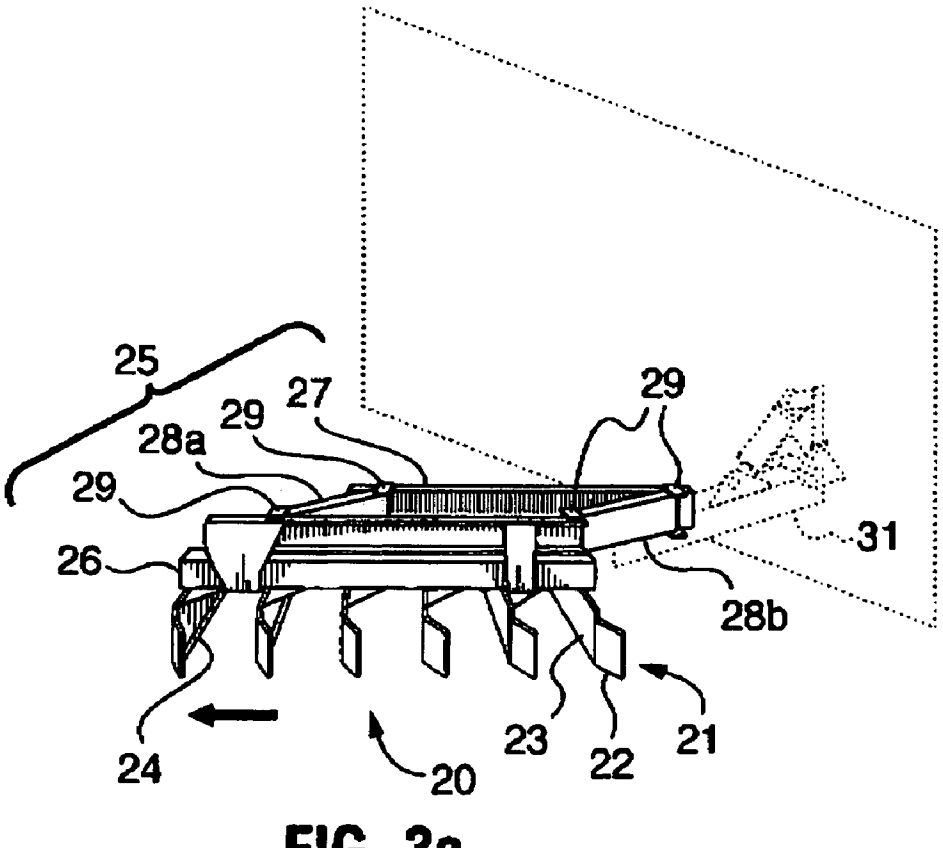
FIG. 3*a* is a perspective view from the front of a second preferred embodiment of the present invention shown in a deployed position.
Figure 4:
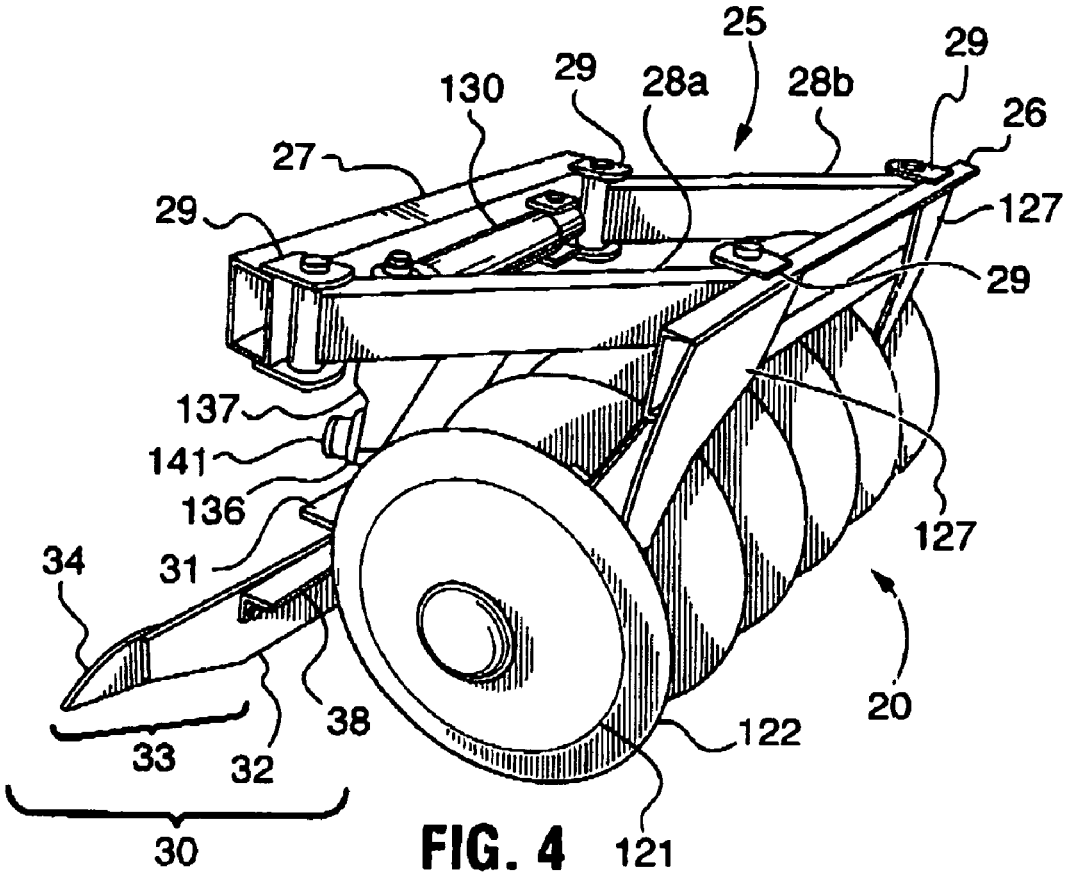
FIG. 4 is a perspective view from the side of third embodiment of the present invention shown in a retracted position.

A particular embodiment of the present invention is illustrated in FIGS. 3*a*, 3*b* and 4 showing the first component 20 mounted on the right side of a machine (for simplicity represented by a rectangle with broken lines) and viewed from the front right-side of the machine 10. It is to be noted that FIG. 3*a* shows the first component 20 in the deployed position and FIG. 3*b* shows the first component 20 in the retracted position as indicated by the arrows in the drawings. Component 20 comprises an articulating frame 25 provided with a rear mounting beam 27, two opposing articulating side rails 28*a* and 28*b* hingedly interconnected with the rear mounting beam 27 via hinge units 29, while the other ends of the opposing articulating side rails 28*a* and 28*b* are hingedly interconnected with an elongate beam, shown by the numeral 26 via hinge units 29. The elongate beam 26 is laterally deployable and retractable relative to rear mounting beam 27 by a hydraulic cylinder 130 as shown in FIG. 4.

Referring again to FIGS. 3*a* and 3*b*, a particular embodiment of the present invention is illustrated by the plurality of spaced-apart downward projecting plates 21 mountable on elongate beam 26 for engaging and working road shoulder regions. Each plate 21 comprises a vertically-oriented leading edge plate portion 22 for cutting into and slicing through a road shoulder comprising granular aggregate materials, and a vertically-oriented following plate portion 23 integrally adjacent to and interconnected with leading-edge plate portion 22 at an inclined angle selected such that granular aggregate materials cut into by leading-edge plate portion 22 are turned over and urged toward the road surface. The bottom edge 24 of the following plate portion 23 is optionally inclined at an angle toward the road surface to enhance and facilitate the turning over and urging by following plate portion 23 of the granular aggregate road shoulder materials cut into by leading-edge plate portion 22. It is to be noted that the plurality of spaced-apart shoulder-engaging plates 21 may be substituted, for example, by a plurality of spaced-apart ploughshare-shaped units (not shown) within the scope of the present invention.

Another particular embodiment of the present invention is illustrated in FIG. 4 wherein the first component 20 is provided with a plurality of spaced-apart rotatable concave discs 121 axially attached to elongate beam 26 by support elements 127. Each rotatable disc 121 is provided with a leading edge portion 122 for cutting into, turning over, and urging granular aggregate material from a road shoulder region toward a road surface.

Figure 5A:
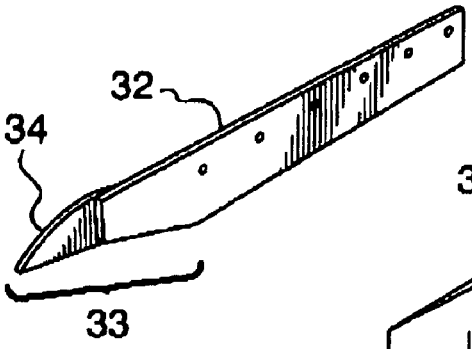
FIGS. 5*a* and 5*b* are perspective views of alternative embodiments for an aspect of the present invention shown in FIG. 4.
Figure 5B:
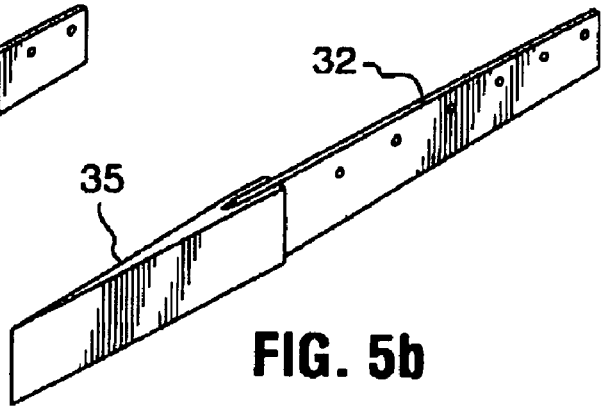
Figure 6A:
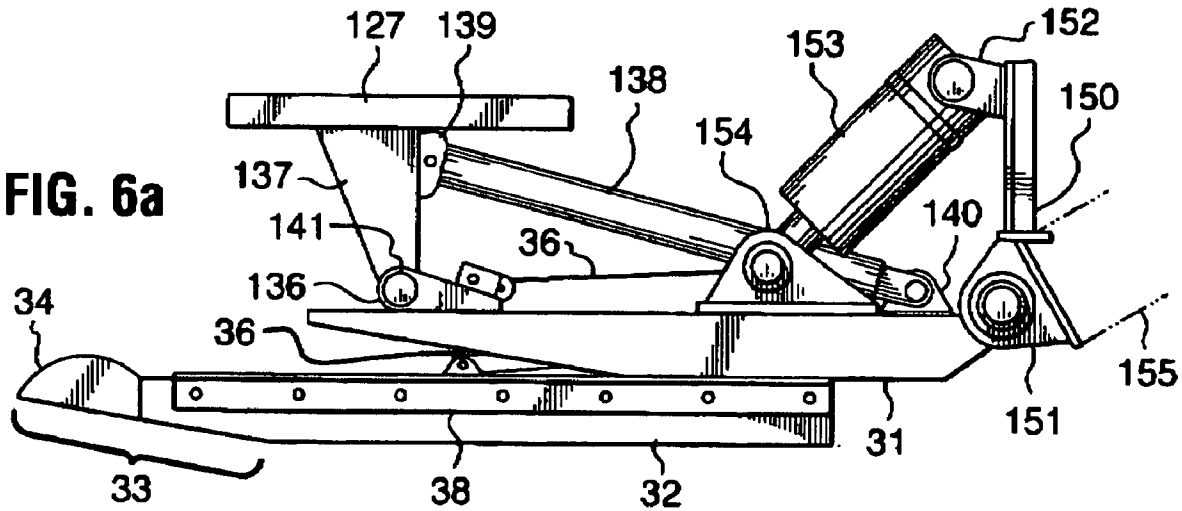
FIG. 6*a* is a partial front view of another preferred embodiment of the present invention.
Figure 6B:
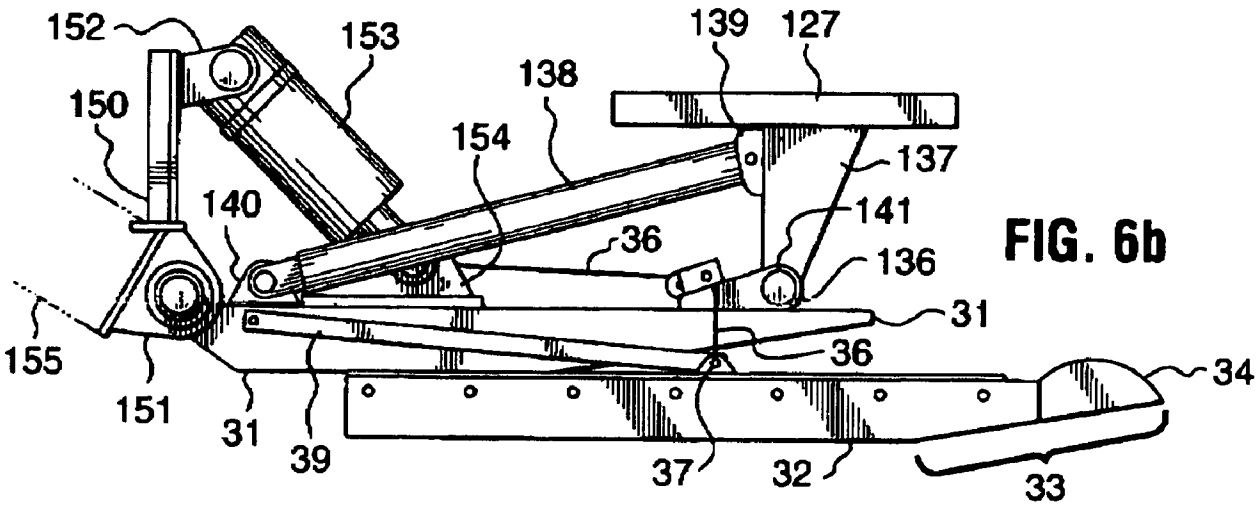
FIG. 6*b* is a partial rear view of the embodiment shown in FIG. 6*a;*
Figure 7A:
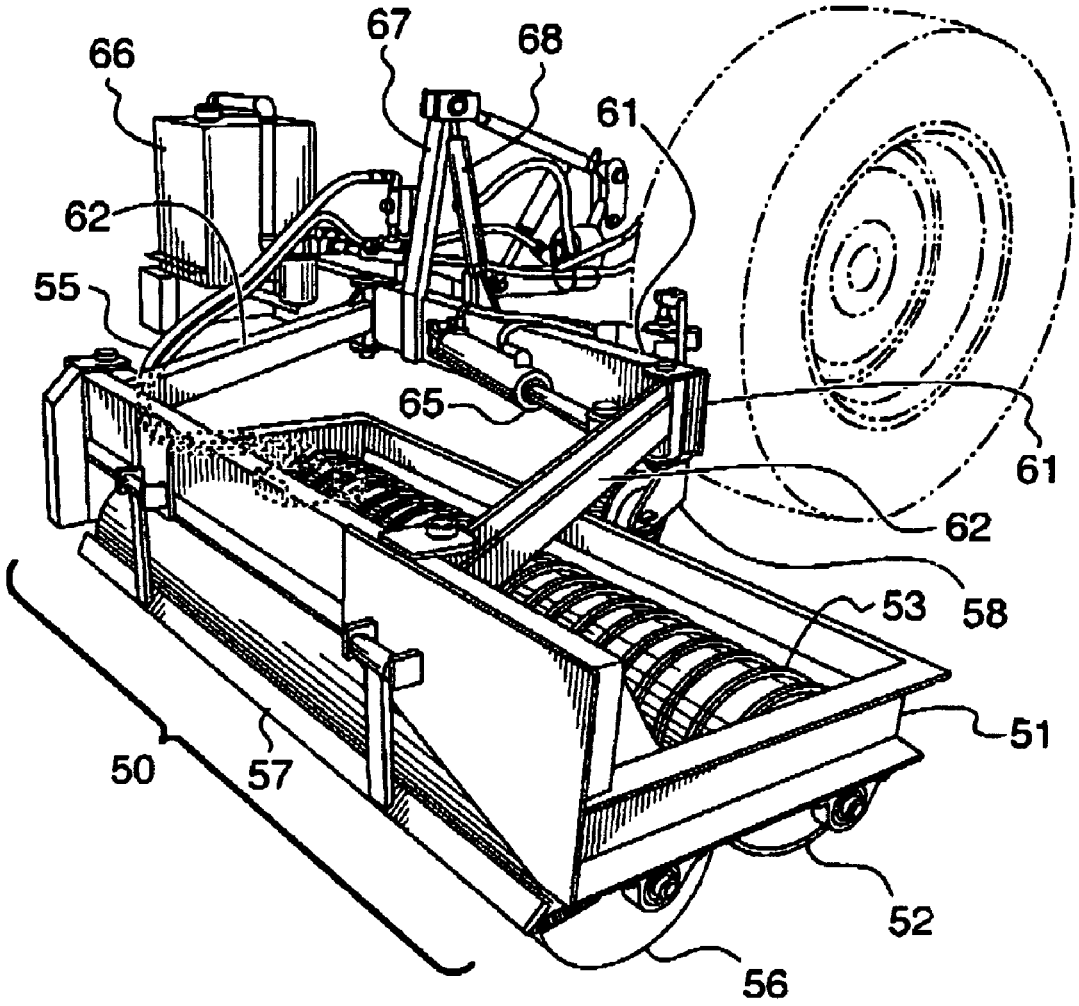
FIG. 7*a* is a perspective view of a further preferred embodiment of the present invention, shown from the right rear.
Figure 7B:
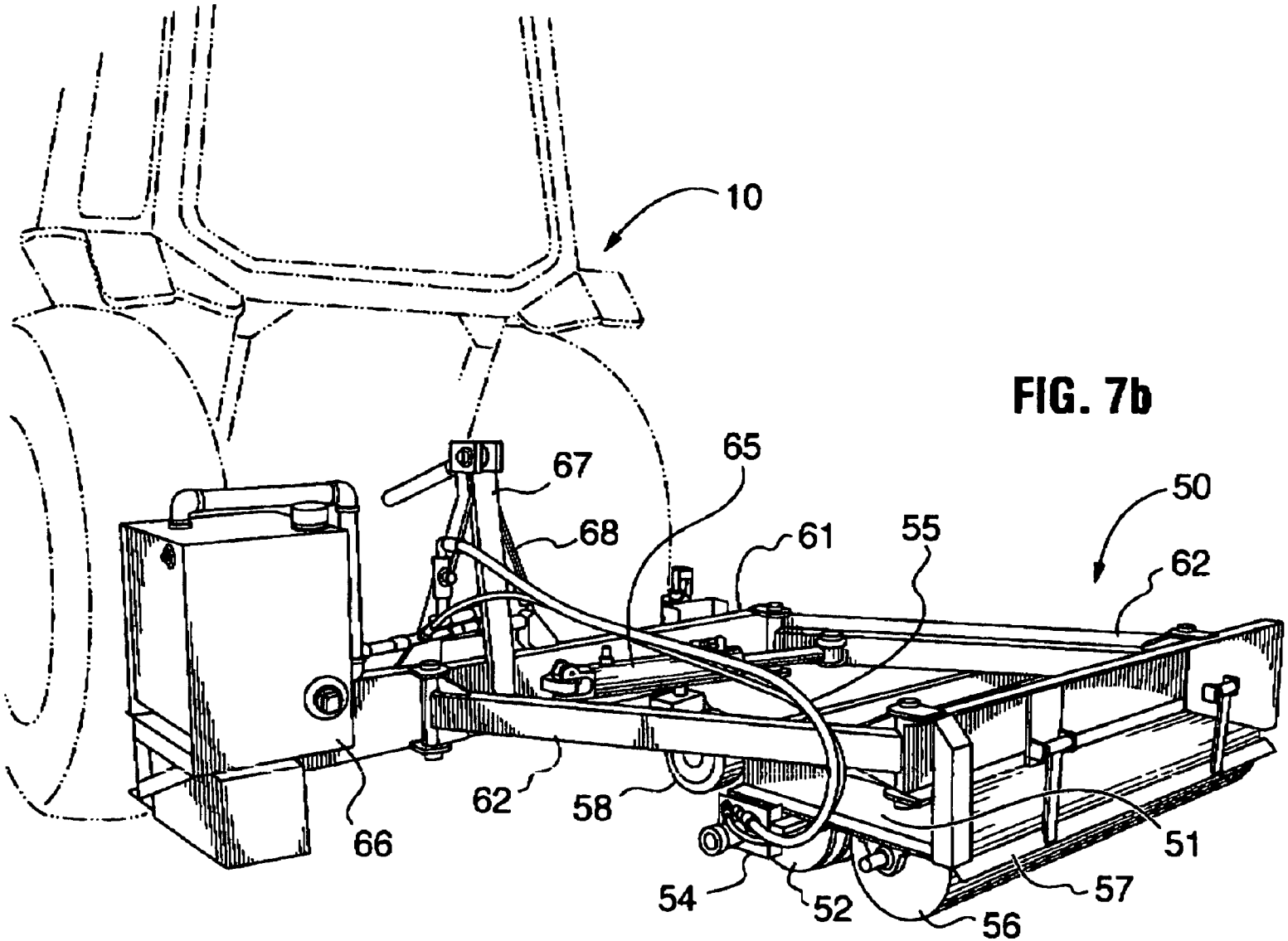
FIG. 7*b* is perspective view of the embodiment from FIG. 7*a*, shown from the left rear.

Preferred embodiments for the second component are shown in FIGS. 4, 5*a*, 5*b*, 6*a* and 6*b*, wherein the second component 30 comprises a mounting plate 31 for cooperating with a mouldboard 32. The mouldboard 32 may be directly interconnected with the mounting plate 31 as shown in FIG. 4, or alternatively, the mouldboard 32 can be lowered from and retracted to mounting plate 31 by an actuator-controllable cable 36 (as illustrated in FIGS. 6*a* and 6*b*) interconnected with a yoke 37 mounted onto a flange 38 to which the mounting plate 32 is securely fixed. A stabilizer bar 39 is pivotably interconnected with the yoke 37 and the mounting plate 31 to stabilize the mouldboard 32 when lowered from mounting plate 31 by cable 36 for road surface working operations. As shown in FIGS. 4 and 5*a*, the mouldboard 32 may be provided with an upwardly inclined distal portion 33. An optional upwardly inclined distal tip 34 may be detachably engaged with the mouldboard 32 to extend the length of the upwardly inclined distal portion 33. In operation, the machine 10 is preferably operated so that the juncture of the bottom edge of mouldboard 32 and the upwardly extending portion 33 runs along the juncture of the road surface and the road shoulder region thereby causing an upwardly sloping edge or ridge of granular aggregate materials to be formed immediately adjacent the road surface, the benefits of which will be explained in more detailed below. Alternatively, if so desired, the mouldboard 32 may be provided with a straight bottom edge which is extendable by a tip 35 also provided with a straight bottom edge, as illustrated in FIG. 5*b*. It has been surprisingly found that, in contrast with the prior art which teaches that mouldboards for working road shoulder and road surfaces should have lengths ranging from at least 1.8 m to 2.4 m (i.e., 6 ft. to 8 ft.) or longer for satisfactory working of road shoulders and road surfaces, relatively short mouldboards from within the range of 45 cm to 102 cm (18 in. to 40 in.) are suitable for transferring granular aggregates urged onto road surfaces during road shoulder working operations, back onto road shoulder regions. Such short mouldboards weigh significantly less than the commonly known prior art mouldboards and therefore are significantly less bulky and easier to manipulate during road shoulder and road surface working and grooming operations. Furthermore, such light-weight short mouldboards minimize and, for the most part, eliminate gouging and ripping damage commonly encountered with the prior art mouldboards when they are used on paved or poured road surfaces.

Figure 8A:
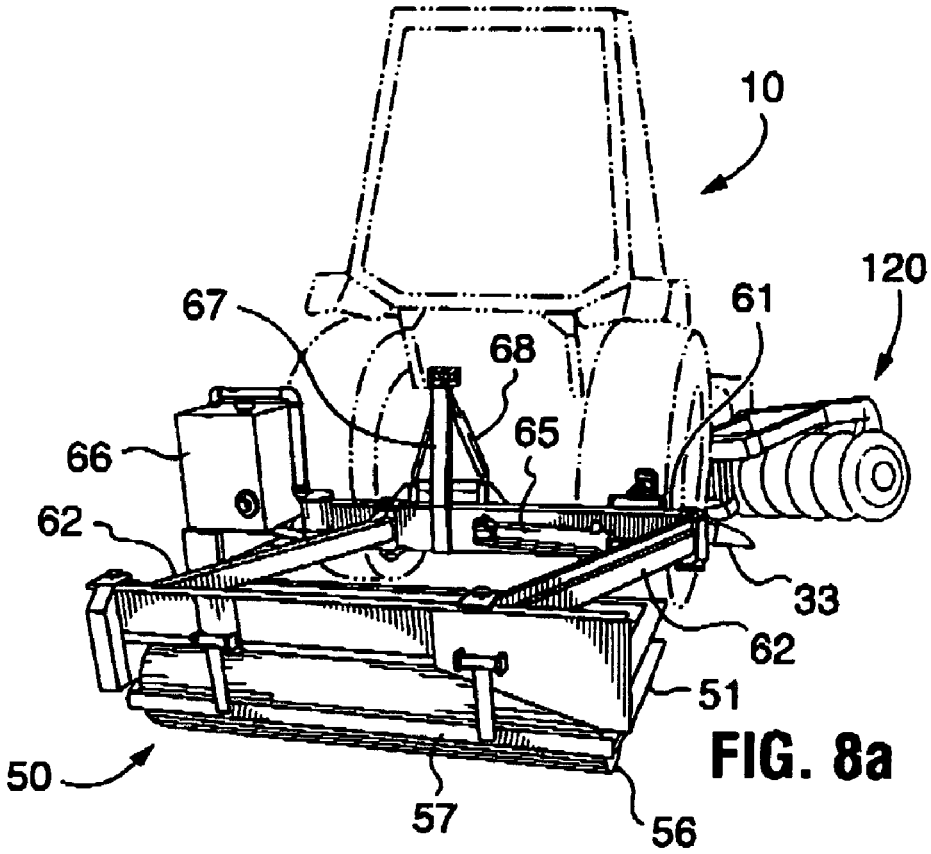
FIG. 8*a* is a rear view showing the embodiment from FIG. 4 in a laterally-deployed position while the embodiment from FIG. 7*a* is in a retracted position.
Figure 8B:
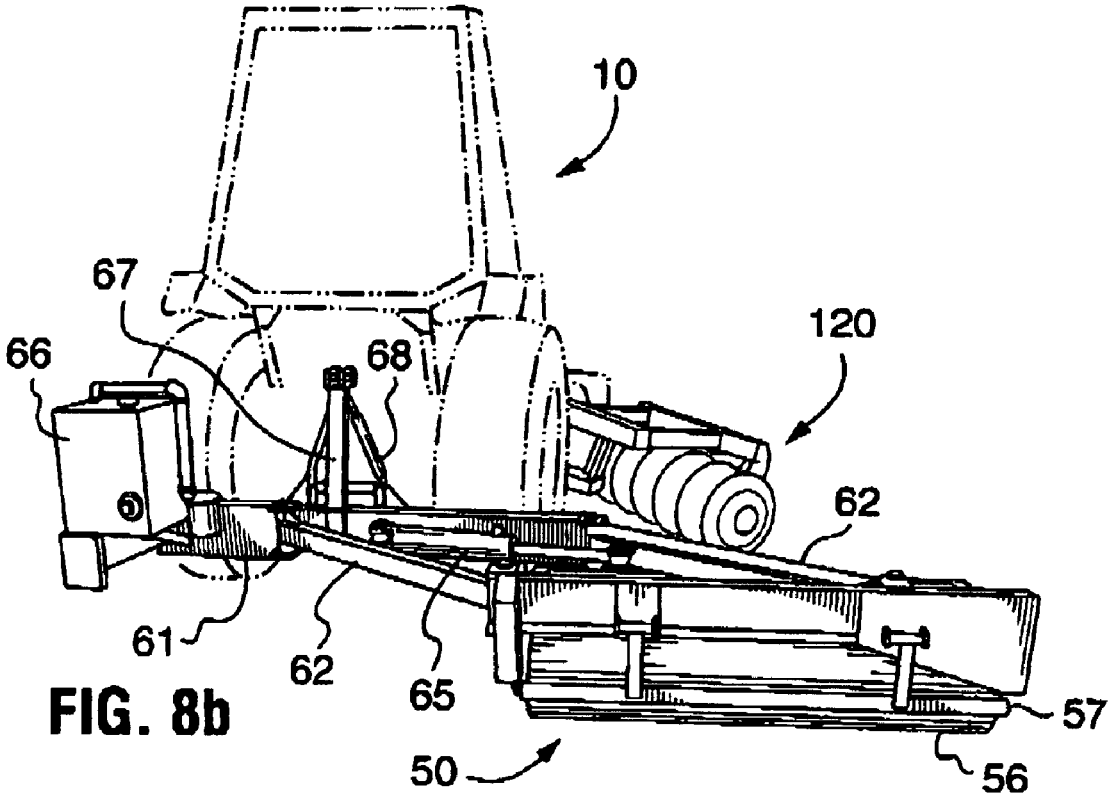
FIG. 8*b* is a rear view showing the embodiments from FIGS. 4 and 7*a* in laterally-deployed positions.

It is to be noted that FIGS. 4, 6*a* and 6*b* illustrate means for combining the first and second components 20 and 30 into a single demountable unit for coupling to a suitable self-propelled operator-controlled machine. The articulating frame 25 is pivotably interconnected to the mounting plate 31 via a yoke 136 wherein the rear mounting beam 27 of the articulating frame 25 is securely engaged with one end of a pivotable strut 137, while the other end of the pivotable strut 137 is pivotably connected with the yoke 136 by a hinge pin 141. The articulating frame 25 can be controllably pivoted around a fulcrum point formed by the interconnection of the yoke 136 and the pivotable strut 137 with the hinge pin 141, by extension of hydraulic cylinder 138 interconnected with a yoke 140 provided on the mounting plate 31 and a second yoke 139 provided near the top of the pivotable strut 137, thereby lowering the distal end of articulating frame 25, i.e., shown as articulating side rail 28*a* while raising the proximal end shown as articulating side rail 28*b* (refer to FIG. 8*a*). Retracting the hydraulic cylinder 138 raises the distal end of articulating frame 25 while lowering the proximal end (refer to FIG. 8*b*). The mouldboard 32 can be concurrently yet independently operated, i.e., lowered and raised from the mounting plate 31 with cable 36 as shown in FIGS. 6*a* and 6*b*. A mounting beam structure 155 which is configured for demountably coupling to a suitable self-propelled operator-controlled machine, is provided with a lower yoke 151 for hingedly interconnecting with the mounting plate 31, the lower yoke 151 interconnected with a support beam 150 to an upper yoke 152. A hydraulic cylinder 153 interconnects the upper yoke 152 of the mounting beam structure 155 with yoke 154 integrally situated on a top portion of the mounting plate 31, thus enabling controllable concurrent raising and lowering of the first and second components 10 and 20 while they are independently and concurrently operated for engaging road shoulders with the hydraulic cylinder 138, and for transferring granular aggregate materials from road surfaces to road shoulders by cable 36.

Yet another particular embodiment of the present invention is illustrated in FIGS. 1, 2, 7, 8 and 9 wherein the third component is configured for distributing and grooming granular aggregate materials across a road shoulder region and for compacting the granular aggregate materials into the road shoulder region. As shown in FIGS. 7*a* and 7*b*, the third component comprises a rectangular framework 51 interconnected by articulating side rails 62 to a support beam 61 from which extends a mounting framework 63 configured to demountably couple to the rear of a self-propelled machine in cooperation with a 3-point hitch 67. A hydraulic cylinder 65 interconnects one articulating side rail 62 with support beam 61 for lateral deployment of the third component 30 outside the rear wheel of machine 10 as shown in FIGS. 1 and 8*b*, and for retraction of component 30 to a position directly behind machine 10 as shown in FIGS. 2 and 8*a*.

Figure 9A:
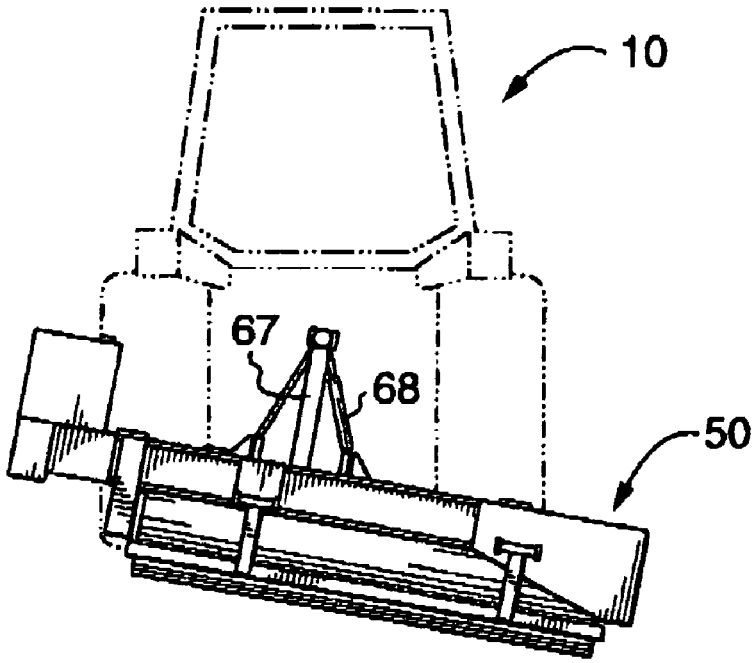
FIGS. 9*a* and 9*b* show the embodiment from FIG. 7*a* pivotably positioned in opposing directions.
Figure 9B:
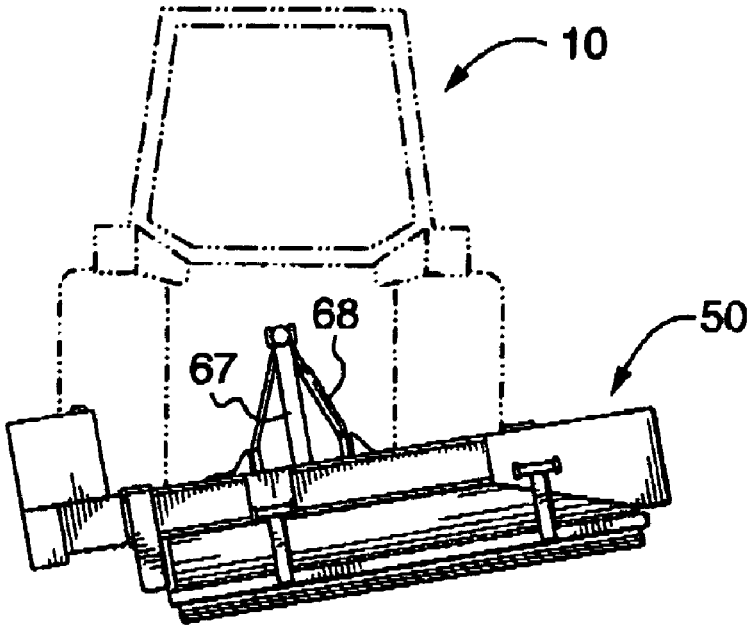

As best seen in FIGS. 1, 2, 7*a* and 7*b*, a leading roller 52 is rotatably mounted within the front section of framework 51 wherein the leading roller 52 is integrally provided with an augered surface 53 for working, distributing and grooming road shoulders. One end of the leading roller 52 is fitted to a hydraulic drive mechanism 54 mounted to the framework 51. The hydraulic drive mechanism 54 is interconnected to a hydraulic oil reservoir 66 with hydraulic hoses 55 along with suitable requisite pumps, valves, actuators and instrumentation (not shown) known to those skilled in this art. The hydraulic drive mechanism 54 is configured to rotate leading roller 52 in a direction opposite to the direction of travel of the machine 10 to which the third component 50 is decoupled, and the augered surface 53 is configured to move materials outward from the inboard side of framework 51, i.e., the side closest to the hydraulic oil reservoir 66, to the outboard side of framework 51 thereby providing means for evenly distributing granular aggregate materials transferred from the road surface across the road shoulder region, and for transferring and clumps of vegetation from the road shoulder surface and discharging the clumps from underneath the outboard side of framework 51 adjacent the outer edge of the road shoulder region. A smooth-faced roller 56 is rotatably mounted within the back section framework 51 behind the leading augered roller 52. It is preferable that a scraper plate 57 is adjustably mounted onto the rear of the framework 51 so that it slidingly communicates with the smooth-faced roller for removing any granular aggregate materials adhering thereto. Those skilled in this art will understand the smooth-faced following roller can be a vibratory roller having one end fitted to a hydraulic drive mechanism (not shown) configured and interconnected with the hydraulic oil reservoir 66. As best can be seen in FIGS. 8*a*, 8*b*, 9*a* and 9*b*, one side element of the three-point hitch 67 is preferably a hydraulic cylinder 68. Extension of the hydraulic cylinder 68 will cause one lateral side of the articulating framework 51 to be lower than the opposite side as shown in FIG. 9*a*, while retraction of the hydraulic cylinder 68 will cause the same lateral side to be elevated with respect to the opposite side as shown in FIG. 9*b*.

In operation, the first component 20 of the road shoulder working, grooming and compacting apparatus 15 is laterally deployed from a machine 10 travelling along a road surface adjacent to a road shoulder region, by actuating hydraulic cylinder 130, and then is pivotably engaged with the road shoulder by concurrently and independently actuating hydraulic cylinders 153 and 39 thereby causing the first component 20 to work the road shoulder and urge granular aggregate materials toward and onto the road surface. The mouldboard 32 of the second component 30 is lowered to slidingly communicate with the road surface thereby transferring the granular aggregate materials deposited onto the road surface by the first component 20, back onto the road shoulder region. The fourth component 45 is lowered to brushingly communicate with the road surface to brush any granular aggregate materials left behind the second component 30 back onto the road shoulder region. The third component 50 is laterally deployed outboard of machine 10 by actuating hydraulic cylinder 65 and then lowered by three-point hitch 65 to rotatingly engage the road shoulder with leading roller 52 provided with augered surface 53 to evenly distribute and groom granular aggregate materials across the surface of the road shoulder region. Any clumps of vegetation and other large objects such as rocks, debris, cans etc. present on or near the road shoulder surface will be transferred by the augered surface 53 of the leading roller 52 to the outboard edge of framework 51 and then will be discharged sideways therefrom beyond the outer edge of the road shoulder region. The following smooth-faced roller 56 will compact the groomed road shoulder. We have found that providing an upwardly inclined slope of granular aggregate material on the road shoulder region immediately adjacent the edge of the road surface prior to compacting results in a very densified portion of road shoulder immediately adjacent the road surface after compacting. Such a densified road shoulder portion facilitates safer egress of vehicles onto the road shoulder region at speed and also, is more resistant to damage caused by heavy rainfalls and weathering. After the road shoulder working, grooming and compacting operations are completed, the four components are raised, then the first and third components are laterally retracted for transport. It is to be understood that the four components comprising the road shoulder working, grooming and compacting apparatus 15 of the present invention are useful when used alone and therefore it is within the scope of this invention, for example, to demountably couple the third component 50 to the rear of a suitable machine for grooming and compacting road shoulders. Alternatively, it is also within the scope of the present invention to provide a unit comprising the first component 20 interconnected and cooperating with the second component 30 as described herein for demountably coupling to a suitable machine for working road shoulders.

While this invention has been described with respect to the preferred embodiments, it is to be understood that various alterations and modifications can be made to components of the road shoulder working, grooming and compacting apparatus within the scope of this invention, which are limited only by the scope of the appended claims.

What is claimed is:

1. A road shoulder working, grooming and compacting apparatus configured for demountably cooperating with a self-propelled operator-controlled machine, the apparatus comprising:

a first component provided with a frame mounting thereon a plurality of cooperating devices for engaging, disrupting and urging granular aggregate materials from an outer portion of a road shoulder region toward and partially onto an adjacent road surface, said frame being movable between a retracted upwardly and inwardly raised position and a laterally-deployed and lowered engaged position wherein the cooperating devices are arranged to engage the outer portion of the road shoulder region;

a second component provided with a structural support cooperating with a mouldboard for transferring granular aggregate materials from the road surface onto the road shoulder region, the structural support movable in a vertical axis between a raised retracted position and a lowered engaged position whereby the mouldboard slidingly communicates with the road surface, the second component positioned posterior to the first component; and a third component provided with a framework mounting therein a plurality of rotatable cooperating devices extending therefrom for evenly distributing and grooming said granular aggregate materials across the road shoulder region and for compacting the groomed road shoulder region, said framework movable between a retracted upward and inward raised position and a laterally-deployed and lowered engaged position wherein the rotatable cooperating devices are arranged to engage and work the road shoulder region, the third component positioned posterior to the second component, whereby the self-propelled operator controlled machine is navigable to travel on the road surface wherefrom the first component is laterally deployable and lowerable to engage and urge granular aggregate materials from the outs portion of the road shoulder region toward and partially onto the road surface wherefrom the granular aggregate materials are transferable by the second component onto the road shoulder region onto the road shoulder region whereto the third component is laterally deployable and lowerable for distributing, grooming, and compacting of said granular aggregate materials.

2. The apparatus of claim 1 additionally provided with a fourth component interposed between the second component and the third component, the fourth component comprising a rotary broom device for sweeping granular aggregate materials left on a road surface by the second component, onto a road shoulder region, said rotary broom device movable in a vertical axis between a retracted raised position and a lowered engaged position whereby the device brushingly communicates with the road surface.

3. The apparatus of claim 1 provided with a plurality of cooperating hydraulically controlled actuators for concurrently but independently: (a) laterally disposing the first and third components cooperating with self-propelled operator-controlled machine on a road surface therefrom to a road shoulder region, (b) controlling the engagement of said laterally disposed components therewith the road shoulder portion, (c) retracting said first and third components therefrom, (d) controlling the communication of the second component with the road surface, and (e) retracting the second component therefrom.

4. The apparatus of claim 2 provided with a plurality of cooperating hydraulically controlled actuators for concurrently but independently: (a) laterally disposing the first and third components cooperating with self-propelled operator-controlled machine on a road surface therefrom to a road shoulder region, (b) controlling the engagement of said laterally disposed components therewith the road shoulder portion, (c) retracting said first and third components therefrom, (d) controlling the communication of the second and fourth component with the road surface, and (e) retracting the second and fourth components therefrom.

5. The apparatus of claim 1 wherein the first component is configured to demountably engage the undercarriage of a self-propelled operator-controlled machine.

6. The apparatus of claim 1 wherein the frame of the first component is pivotably engaged with the support structure of the second component wherefrom the first component is laterally extendable and pivotable for controllably engaging an outer portion of a road shoulder region and retractable therefrom, said support structure of the second component configured to demountably engage the undercarriage of a self-propelled operator-controlled machine.

7. The apparatus of claim 1 wherein the plurality of cooperating devices mounted thereon the frame of said first component comprises a plurality of substantially parallel spaced apart discs, each disc provided with a cutting edge about its periphery arranged to engage a road shoulder for digging up and urging granular aggregate material towards a road surface when said first component is engaged with a road shoulder region.

8. The apparatus of claim 1 wherein the plurality of cooperating devices mounted thereon the frame of said first component comprises a plurality of substantially parallel spaced apart ploughshares, each ploughshare configured with a leading cutting edge and a generally inward inclined concave following surface arranged to engage a road shoulder for digging up and urging granular aggregate material towards a road surface when said first component is engaged with a road shoulder region.

9. The apparatus of claim 1 wherein the plurality of cooperating devices mounted thereon the frame of said first component comprises a plurality of substantially parallel spaced apart elongate plates, each plate configured with a leading plate portion for cutting into a road shoulder and a generally inward inclined following plate portion arranged for digging up and urging granular aggregate material from the road should towards a road surface when said first component is engaged with a road shoulder region.

10. The apparatus of claim 9 wherein each elongate plate is provided with an inclined flange extending along an inward facing edge of said plate configured cutting into a road shoulder and urging granular aggregate material from the road should towards a road surface when said first component is engaged with a road shoulder region.

11. The apparatus of claim 1 wherein the second component is provided with a mouldboard comprising a bottom edge having an upward inclined distal end portion.

12. The apparatus of claim 1 wherein the mouldboard is provided with a concave forward-facing face along its longitudinal axis, the mouldboard further provided with a flat bottom edge surface.

13. The apparatus of claim 1 wherein the third component is provided with a framework having mounted therein a leading elongate augering roller for movably engaging a worked road shoulder region for distributing and grooming granular aggregate materials thereacross the road shoulder region from a road surface edge to the outer portion of the road shoulder region when said third component is laterally disposed in an engaged position from a self-propelled operator-controlled machine travelling along a road surface adjacent said road shoulder region.

14. The apparatus of claim 13 wherein the augering roller is provided with a drive means interconnected with one of the augering roller for rotating said augering roller in a direction opposite to the direction of travel of said self-propelled operator-controlled machine, said framework additionally having mounted therein a following compacting roller for compacting said groomed road shoulder region.

15. The apparatus of claim 13 wherein the compacting roller is provided with a longitudinally extending scraper blade having a cleaning edge cooperating with said roller for removing material from an outer surface of the roller, the scraper blade adjustably interconnected with said framework.

16. The apparatus of claim 13 wherein the compacting roller is a vibratory compacting roller.

17. The apparatus of claim 13 wherein the third component is configured to demountably engage the undercarriage of a self-propelled operator-controlled machine.

18. The apparatus of claim 13 wherein the third component is configured to cooperatingly demountably engage the undercarriage and drive train components of a self-propelled operator-controlled machine.

19. An apparatus for working, grooming and compacting road shoulders, the apparatus comprising:

a self-propelled operator-controlled machine;

a first component cooperatingly engaged with said machine, the first component provided with a frame mounting thereon a plurality of cooperating devices for engaging, disrupting and urging granular aggregate materials from an outer portion of a road shoulder region toward and partially onto a road surface, said frame movable between a retracted upward and inward raised position and an engaged position wherein the cooperating devices are arranged to engage the outer portion of the road shoulder region;

a second component cooperatingly engaged with said machine, the second component provided with a structural support cooperating with a mouldboard for transferring granular aggregate materials from the road surface onto the road shoulder region, the structural support movable in a vertical axis between a raised retracted position and a lowered engaged position whereby the mouldboard slidingly communicates with the road surface, the second component positioned posterior to the fist component; and a third component cooperatingly engaged with said machine, the third component provided with a framework mounting therein a plurality of rotatable cooperating devices extending therefrom for evenly distributing and grooming said granular aggregate materials across the road shoulder region and compacting the groomed road shoulder region, said frame movable between a retracted upward and inward raised position and an engaged position wherein the rotatable cooperating devices are arranged to engage and work the road shoulder region, the third component positioned posterior to the second component, whereby the self-propelled operator-controlled machine is navigable to travel on the road surface wherefrom the first component is laterally deployable and lowerable to engage and urge granular aggregate materials from the outer portion of the road shoulder region toward and partially onto the road surface wherefrom the granular aggregate materials are transferable by the second component onto the road shoulder region whereto the third component is laterally deployable and lowerable for distributing, grooming, and compacting of said granular aggregate materials.

20. The apparatus of claim 19 additionally provided with a fourth component interposed between the second component and the third component, the fourth component comprising a rotary broom device for sweeping granular aggregate materials left on a road surface by the second component, onto a road shoulder region, said rotary broom device movable in a vertical axis between a retracted raised position and a lowered engaged position whereby the device brushingly communicates with the road surface.

21. The apparatus of claim 19 provided with a plurality of cooperating hydraulically controlled actuators for concurrently but independently: (a) laterally disposing the first and third components cooperating with the self-propelled operator-controlled machine on a road surface therefrom to a road shoulder region, (b) controlling the engagement of said laterally disposed components therewith the road shoulder portion, (c) retracting said first and third components therefrom, (d) controlling the communication of the second component with the road surface, and (e) retracting the second component therefrom.

22. The apparatus of claim 20 provided with a plurality of cooperating hydraulically controlled actuators for concurrently but independently: (a) laterally disposing the first and third components cooperating with the self-propelled operator-controlled machine on a road surface therefrom to a road shoulder region, (b) controlling the engagement of said laterally disposed components therewith the road shoulder portion, (c) retracting said first and third components therefrom, (d) controlling the communication of the second and fourth component with the road surface, and (e) retracting the second and fourth components therefrom.

23. The apparatus of claim 19 wherein the first component is configured to cooperatingly engage the undercarriage of the self-propelled operator-controlled machine.

24. The apparatus of claim 19 wherein the frame of the first component is pivotably engaged with the support structure of the second component wherefrom the first component is laterally extendable and pivotable for controllably engaging an outer portion of a road shoulder region and retractable therefrom, said support structure of the second component configured to cooperatingly engage the undercarriage of the self-propelled operator-controlled machine.

25. The apparatus of claim 19 wherein the plurality of cooperating devices mounted thereon the frame of said first component comprises a plurality of substantially parallel spaced apart discs, each disc provided with a cutting edge about its periphery arranged to engage a road shoulder for digging up and urging granular aggregate material towards a road surface when said first component is engaged with a road shoulder region.

26. The apparatus of claim 19 wherein the plurality of cooperating devices mounted thereon the frame of said first component comprises a plurality of substantially parallel spaced apart ploughshares, each ploughshare configured with a leading cutting edge and a generally inward inclined concave following surface arranged to engage a road shoulder for digging up and urging granular aggregate material towards a road surface when said first component is engaged with a road shoulder region.

27. The apparatus of claim 19 wherein the plurality of cooperating devices mounted thereon the frame of said first component comprises a plurality of substantially parallel spaced apart elongate plates, each plate configured with a leading plate portion for cutting into a road shoulder and a generally inward inclined following plate portion arranged for digging up and urging granular aggregate material from the road should towards a road surface when said first component is engaged with a road shoulder region.

28. The apparatus of claim 27 wherein each elongate plate is provided with an inclined flange extending along an inward facing edge of said plate configured cutting into a road shoulder and urging granular aggregate material from the road should towards a road surface when said first component is engaged with a road shoulder region.

29. The apparatus of claim 19 wherein the second component is provided with a mouldboard comprising a bottom edge having an upward inclined distal end portion.

30. The apparatus of claim 19 wherein the mouldboard is provided with a concave forward-facing face along its longitudinal axis, the mouldboard further provided with a flat bottom edge surface.

31. The apparatus of claim 19 wherein the third component is provided with a framework having mounted therein a leading elongate augering roller for movably engaging a worked road shoulder region for distributing and grooming granular aggregate materials thereacross the road shoulder region from a road surface edge to the outer portion of the road shoulder region when said third component is laterally disposed in an engaged position from the self-propelled operator-controlled machine traveling along a road surface adjacent said road shoulder region.

32. The apparatus of claim 31 wherein the augering roller is provided with a drive means interconnected with one end of the augering roller for rotating said augering roller in a direction opposite to the direction of travel of said self-propelled operator-controlled machine, said framework additionally having mounted therein a following compacting roller for compacting said groomed road shoulder region.

33. The apparatus of claim 31 wherein the compacting roller is provided with a longitudinally extending scraper blade having a cleaning edge cooperating with said roller for removing material from an outer surface of the roller, the scraper blade adjustably interconnected said framework.

34. The apparatus of claim 31 wherein the compacting roller is a vibratory compacting roller.

35. The apparatus of claim 31 wherein the third component is configured to cooperatingly engage the undercarriage of the self-propelled operator-controlled machine.

36. The apparatus of claim 31 wherein the third component is configured to cooperatingly engage the undercarriage and drive train components of the self-propelled operator-controlled machine.

* * * * *